US007461925B2

(12) United States Patent
Smith et al.

(10) Patent No.: US 7,461,925 B2
(45) Date of Patent: Dec. 9, 2008

(54) ADJUSTING POWER

(75) Inventors: David E. Smith, Vancouver, WA (US); Steven B. Elgee, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 452 days.

(21) Appl. No.: 11/073,139

(22) Filed: Mar. 4, 2005

(65) Prior Publication Data

US 2006/0197805 A1 Sep. 7, 2006

(51) Int. Cl.
*B41J 2/05* (2006.01)

(52) U.S. Cl. ..... 347/60

(58) Field of Classification Search ..... 347/56, 347/102, 18, 60, 185, 188, 189, 192, 194, 347/196; 219/216; 399/37, 70
See application file for complete search history.

(56) References Cited

U.S. PATENT DOCUMENTS

| | | | |
|---|---|---|---|
| 4,459,469 A | 7/1984 | Ishima | |
| 4,495,568 A | 1/1985 | Gilbert et al. | |
| 4,539,487 A | 9/1985 | Ishii | |
| 4,564,749 A | 1/1986 | Ishima | |
| 4,567,353 A | 1/1986 | Aiba | |
| 4,590,362 A | 5/1986 | Ishima | |
| 4,660,057 A | 4/1987 | Watanabe et al. | |
| 4,809,608 A | 3/1989 | Wolnick et al. | |
| 5,086,570 A | 2/1992 | Matheus | |
| 5,212,498 A | 5/1993 | Sugimori | |
| 5,214,442 A | 5/1993 | Roller | |
| 5,229,651 A | 7/1993 | Baxter, Jr. et al. | |
| 5,248,967 A | 9/1993 | Daneshfar | |
| 5,349,905 A | 9/1994 | Taylor et al. | |
| 5,390,011 A | 2/1995 | Theodoulou | |
| 5,412,303 A | 5/1995 | Wernicki | |
| 5,422,662 A | 6/1995 | Fukushima et al. | |
| 5,545,876 A | 8/1996 | Park | |
| 5,682,185 A | 10/1997 | Wade et al. | |
| 5,730,438 A | 3/1998 | Webb et al. | |
| 5,774,155 A * | 6/1998 | Medin et al. | 347/102 |
| 5,781,205 A | 7/1998 | Silverbrook | |
| 5,841,449 A | 11/1998 | Silverbrook | |
| 5,844,581 A | 12/1998 | DeJoseph et al. | |
| 6,072,163 A | 6/2000 | Armstrong et al. | |
| 6,199,969 B1 | 3/2001 | Haflinger et al. | |
| 6,244,700 B1 | 6/2001 | Kimura et al. | |
| 6,302,507 B1 | 10/2001 | Prakash et al. | |
| 6,315,381 B1 | 11/2001 | Wade et al. | |
| 6,334,660 B1 | 1/2002 | Holstun et al. | |

(Continued)

FOREIGN PATENT DOCUMENTS

EP 0260629 9/1987

(Continued)

OTHER PUBLICATIONS

Hewlett-Packard Company, U.S. Appl. No. 10/832,089, filed Apr. 26, 2004, entitled: "Air Heating Apparatus.".

(Continued)

*Primary Examiner*—Stephen D Meier
*Assistant Examiner*—Geoffrey Mruk

(57) ABSTRACT

Embodiments of a method and apparatus for adjusting power are disclosed.

11 Claims, 3 Drawing Sheets

U.S. PATENT DOCUMENTS

| | | | |
|---|---|---|---|
| 6,386,674 | B1 | 5/2002 | Corrigan, III et al. |
| 6,396,674 | B1 | 5/2002 | Chen et al. |
| 6,409,298 | B1 | 6/2002 | Ahne et al. |
| 6,415,244 | B1 | 7/2002 | Dickens et al. |
| 6,418,002 | B1 | 7/2002 | Yang et al. |
| 6,428,160 | B2 | 8/2002 | Roy et al. |
| 6,528,957 | B1 | 3/2003 | Luchaco |
| 6,565,176 | B2 | 5/2003 | Anderson et al. |
| 6,601,001 | B1 | 7/2003 | Moore |
| 6,688,719 | B2 | 2/2004 | Silverbrook et al. |
| 6,787,050 | B2 | 9/2004 | Parish |
| 2001/0019279 | A1 | 9/2001 | Martin et al. |
| 2002/0149637 | A1 | 10/2002 | Miyakoshi et al. |
| 2003/0193538 | A1 | 10/2003 | Silverbrook et al. |
| 2004/0039960 | A1 | 2/2004 | Kasssayan |
| 2004/0084971 | A1 | 5/2004 | Shukla et al. |
| 2004/0184208 | A1 | 9/2004 | Liu |

FOREIGN PATENT DOCUMENTS

| | | |
|---|---|---|
| GB | 2355518 | 4/2001 |
| JP | 08308101 | 11/1996 |
| WO | WO02/10861 | 2/2002 |

OTHER PUBLICATIONS

Hewlett-Packard Company, U.S. Appl. No. 10/869,673, filed Jun. 15, 2004, entitled: "Power Controller.".

Hewlett Packard Company, U.S. Appl. No. 10/965,459, filed Oct. 13, 2004, entitled: "Determining A Difference Between A Level Of Power To Be Supplied . . . ".

* cited by examiner

ADJUSTING POWER

BACKGROUND

Systems that make use of heating elements can sometimes draw, or attempt to draw, current from a power source that can cause a change in a voltage supplied by the power source. This voltage change may be a cause of an undesirable flicker in lights supplied by the power source.

BRIEF DESCRIPTION OF THE DRAWINGS

The drawings referenced herein form a part of the specification. Features shown in the drawing are meant as illustrative of only some embodiments, and not of all embodiments.

Shown in FIG. 1 is a simplified block diagram of an embodiment of a system for controlling power.

Figure 2:
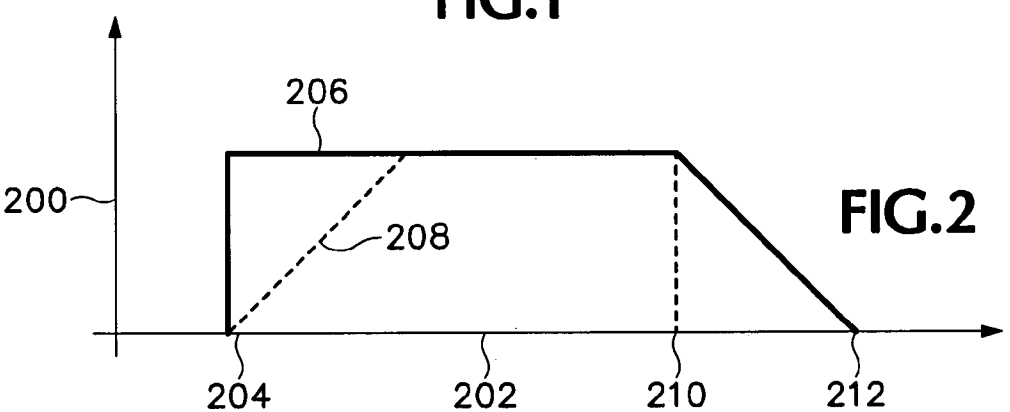

Shown in FIG. 2 is a graph for illustrating an embodiment of a technique for applying power.

Figure 3:
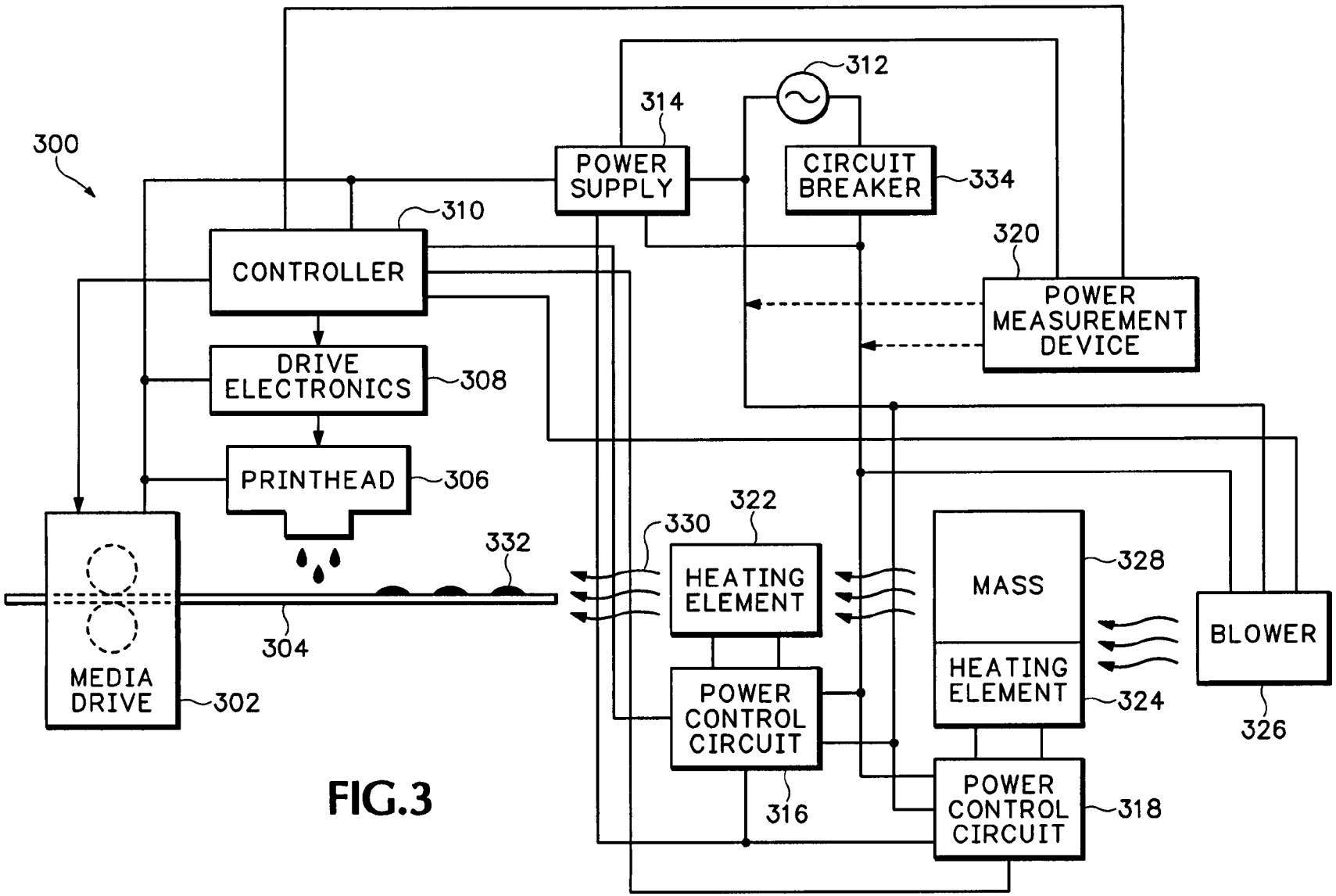

Shown in FIG. 3 is a simplified block diagram of an embodiment of an image forming system.

Figure 4:
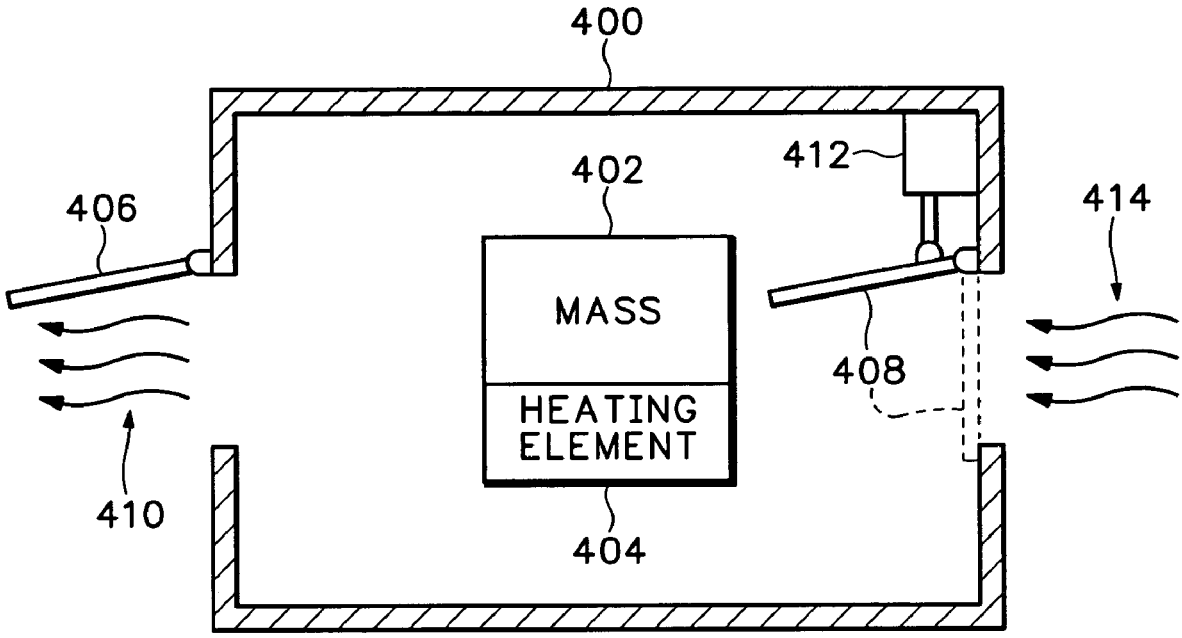

Shown in FIG. 4 is a simplified drawing of an embodiment of an enclosure.

DETAILED DESCRIPTION

Some systems, such as embodiments of image forming systems, include embodiments of heaters, such as heating elements, for heating air that is used for vaporizing fluid in colorant, such as ink, ejected onto media. Depending upon the image forming system, the heating elements can draw considerable current from the power source, such as an AC power mains circuit (referred to as an AC power mains), supplying the image forming system. During an image forming operation, the image forming system will draw current from the AC power mains, in addition to the current used to power the heating element, to power other assemblies in the image forming system.

Applying power or stopping the application of power to the heating elements may result in a relatively rapid change in the current drawn from the power source. This relatively rapid change in current may cause the voltage of the power source to transiently deviate from its nominal value in a manner that may cause a perceptible change in the intensity of light output of lights supplied from the power source.

Figure 1:
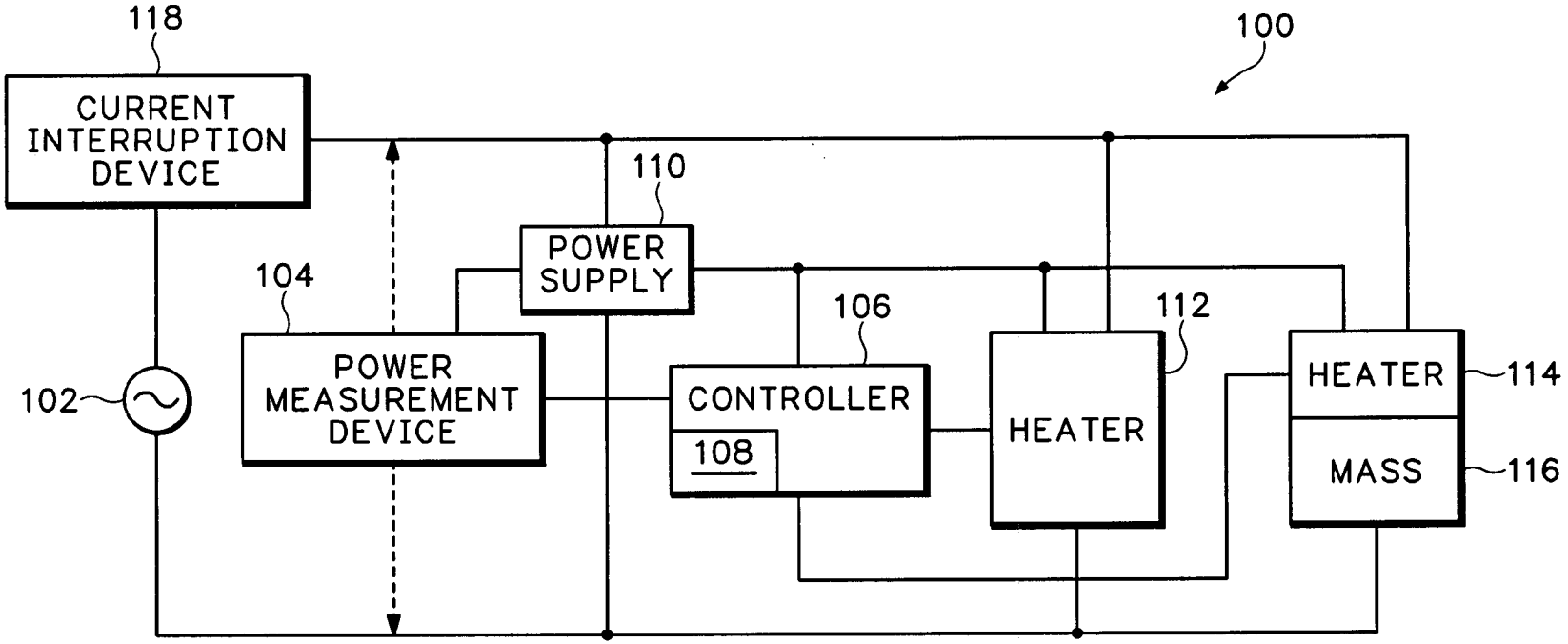

Shown in FIG. 1 is a simplified block diagram of an embodiment of a system for controlling power. An embodiment of a system, such as system 100, operates to reduce variation in current drawn from a power source, such as AC power mains 102, below the degree of variation that would occur without the operation of system 100. In some embodiments, AC power mains 102 may be configured to provide 110-120 VRMS or 220-240 VRMS at 50 or 60 Hz. In some embodiments, AC power mains 102 may include an embodiment of a current interruption device 118, such as a circuit breaker or a fuse, to interrupt the flow of current to system 100 when current exceeds a threshold. The use of current interruption device 118 reduces the likelihood that currents may be drawn from AC power mains 102 of a magnitude that present a safety hazard or can cause damage to system 100.

An embodiment of a device, such as power measurement device 104, provides a measurement of power supplied from AC power mains 102 to an embodiment of a controller, such as controller 106. In one embodiment, power measurement device 104 may include a circuit to measure a voltage provided by AC power mains 102 and a current drawn from AC power mains 102 and generate a signal indicative of the power provided to system 100 by AC power mains 102. In various embodiments, controller 106 may include a processing device, such as a microprocessor, executing firmware or software instructions to accomplish its tasks. Or, controller 106 may be included in an application specific integrated circuit (ASIC), formed of hardware and controlled by firmware specifically designed for the tasks it is to accomplish.

In one embodiment, controller 106 may include an embodiment of a computer readable medium, such as, in one embodiment, memory 108 for storing executable instructions, such as software or firmware, used by controller 106 in performing operations to reduce variation in current drawn from AC power mains 102. In various embodiments of system 100, the software or firmware may be stored on an embodiment of a computer-readable media included with or separate from controller 106. A computer readable medium can be any media that can contain, store, or maintain programs and data for use by or in connection with the execution of instructions by a processing device. Computer readable media can comprise any one of many physical media such as, for example, electronic, magnetic, optical, electromagnetic, infrared, semiconductor media, or any other suitable media. More specific examples of suitable computer-readable media include, but are not limited to, a portable magnetic computer diskette such as floppy diskettes or hard drives, a random access memory (RAM), a read-only memory (ROM), an erasable programmable read-only memory, or a portable compact disc. Computer readable media may also refer to signals that are used to propagate the computer executable instructions over a network or a network system such as the Internet.

Power supply 110 is configured to supply power at voltages used by controller 106 and power measurement device 104 and other assemblies within system 100 that may use D.C. voltages for operation. Controller 106 is coupled to heater 112 and provides a signal used by heater 112 for controlling the operation of heater 112. Controller 106 is also coupled to heater 114 and provides a signal used by heater 114 for controlling the operation of heater 114.

In the embodiments of heater 112 and heater 114 disclosed in FIG. 1, heater 112 and heater 114 each include embodiments of power controllers that are used to control the application of power from AC power mains 102 to heating elements included in each of heater 112 and heater 114. In one embodiment, the power controllers may include one or more switching devices, such as a power MOSFET. To adjust the level of the power supplied to the heating elements included within heater 112 and heater 114 by AC power mains 102, the duty cycle of a digital signal provided by controller 106 to heater 112 and heater 114 would be adjusted. In this embodiment, controller 106 would supply a pulse width modulated (PWM) signals to each of the power controllers included within heater 112 and heater 114.

In other embodiments of the power controllers that may be used, a switching device such as triac could be used. In this embodiment of the power controllers, the signals provided by controller 106 to each of the power controllers included within heater 112 and heater 114 are used to initiate conduction of the triac, this may be referred to as firing the triac. To adjust the level of the power supplied to the heating elements included within heater 112 and heater 114, the time during the voltage waveform cycle of AC power mains 102 at which the triac is fired would be adjusted.

In one embodiment of system 100, heater 112 may be included as part of a dryer. In this embodiment, a blower or fan (not shown in FIG. 1) would move air across the heating elements included within heater 112 to warm the air. The warmed air may then be used to vaporize fluid. In an embodiment, heater 112 may include temperature sensor that is coupled to controller 106 to assist in determining how controller 106 adjusts the power supplied to heater 112. In other embodiments of system 100, the temperature sensor may be provided separately from heater 112.

An embodiment of a mass, such as mass 116, may be associated with heater 114 in an embodiment. Mass 116 and heater 114 may be physically configured to allow heat generated by the heating elements in heater 114 to heat mass 116 for storing heat energy in mass 116. An embodiment of a blower or fan that may be included within system 100 can be configured to move air across the heating elements included within heater 112 and across mass 116 to transfer heat generated within heater 112 and the heat stored within mass 116 to the air. The amount of material included within mass 116 may be selected based upon the desired degree of air heating to be provided by mass 116. In general, a larger quantity of a particular material will have the capability to store more heat energy and consequently heat a larger volume of air to a desired temperature. Some examples of materials that may be used for mass 116 include metal, such as aluminum, iron, or steel, paraffin, or a phase change material. An embodiment of heater 114 may include a temperature sensor that is coupled to controller 106 to assist in determining how controller 106 adjusts the power supplied to heater 114. In other embodiments of system 100, the temperature sensor may be provided separately from heater 114.

Operation of system 100 causes current to be drawn from AC power mains 102 to provide power to the various assemblies included within system 100. In one embodiment system 100 may be operated to reduce variation in the current drawn by system 100 from AC power mains 102. Reducing the variation in current drawn by system 100 causes a reduction in the magnitude of voltage transients generated in the voltage provided by AC power mains 102. As mentioned previously, reduction in the magnitude of voltage transients may provided the beneficial effect of reducing variation in the intensity of light emitted by light sources that may also be supplied with power from AC power mains 102.

The current drawn by system 100 from AC power mains 102 includes the current drawn by heater 114 for powering its heating elements, the current drawn by heater 112 for powering its heating elements, and the current drawn by other assemblies included within system 100, such as controller 106, power measurement device 104, and the power control electronics that may be associated with heater 112 and heater 114, drawn through power supply 110. It is likely, for at least some embodiments of system 100, that the sum of the current drawn by heater 114 and heater 112 is significantly greater than the current drawn by the other assemblies included within system 100. Furthermore, because of the characteristics of the loads presented by heater 112 and heater 114 it is possible that the magnitude of the variability in the current drawn by these loads, individually, over time is significantly greater than the magnitude of the variability in the current drawn by the other assemblies within system 100 during its operation.

By operating controller 106 so that a sum of a level of power supplied to heater 112 and a level of power supplied to heater 114 is maintained within a range of a predetermined level of power, the variability in a magnitude of the sum of the current drawn by heater 112 and heater 114 may be reduced (by appropriately selecting a value of this range), thereby reducing the magnitude of the variability of the current drawn from AC power mains 102 to supply system 100 from what it would be without such control. Additionally, by controlling the level of power in this manner, the likelihood of causing actuation of current interruption device 118 may be reduced. In one embodiment the range would be determined by such factors including the measurement accuracy and repeatability of power measurement device 104 and the accuracy and repeatability with which controller 106 and power controllers that may be included within heater 112 and heater 114 can control the power drawn from AC power mains 102 by the heating elements included within them.

Controller 106 may be operated to maintain the sum of the level of the power supplied to heater 112 and the level of the power supplied to heater 114 within the range of the predetermined value using the signal provided by power measurement device 104 indicative of the power supplied by AC power mains 102. Alternatively, controller 106 may be operated to maintain the power supplied to system 100 (which are supplied to the various loads included within system 100) by AC power mains 102 within a range of the predetermined value using the signal provided by power measurement device 104. Controller 106 may be configured to perform a comparison between a desired level of power to be supplied by AC power mains 102 to system 100 and a measurement of the actual power supplied by AC power mains 102 to system 100 as indicated by the signal provided by power measurement device 104 to controller 106.

A value for the desired level of the power to be supplied may be stored in memory 108. This value may, in some embodiments, have been hard coded into memory 108. In other embodiments, this value may be entered by a user and stored within memory 108, downloaded into memory 108 from an external system, or otherwise placed into memory 108. In some embodiments of system 100, it is the case that to achieve a desired level of performance, heater 112 and heater 114 are operated to dissipate as much heat as possible without causing actuation of current interruption device 118. This would involve operating heater 112 and heater 114 in a manner such that the current drawn by system 100 is close to, but below by a desired margin, a level of current at which actuation of current interruption device 118 occurs to get the desired heat dissipation in heater 112 and heater 114. Operation in this manner may be desired in an application in which it is desired to as rapidly vaporize fluid, using the heat provided by heater 112 and heater 114, as would be permitted by the power supplying capabilities of AC power mains 102 without causing actuation of current interruption device 118.

Based upon the comparison performed by controller 106, controller 106 determines a difference between the predetermined level of power to be supplied to system 100, for which a value corresponding to the desired level of power may in an embodiment may be stored in memory 108, and a level of power supplied by AC power mains 102 to system 100, as indicated by the signal provided by power measurement device 104 to controller 106. The difference determined represents an error signal. If the error signal indicates that the level of the power supplied to system 100 exceeds the predetermined level of power that is desired, then controller 106 provides the signal or signals to make the appropriate adjustment to the power controller included in heater 112, the power controller in heater 114, or both, to reduce the power supplied to one or both of heater 112 and heater 114 so that the difference between the power supplied to system 100 and the predetermined level of power is reduced and held within the range.

If the error signal indicates that the level of the power supplied to system 100 is below the predetermined level of power that is desired, then controller 106 provides the signal or signals to make the appropriate adjustment to the power controller included in heater 112, the power controller in heater 114, or both to increase the power supplied to one or both of heater 112 and heater 114 so that the difference between the power supplied to system 100 and the predetermined level of power is reduced and held within the range.

The operation of the feedback loop reduces the magnitude of the error signal over what it would have been without application of feedback. The magnitude of the steady state value of the difference is influenced by the characteristics of the feedback loop, thereby affecting the range about the predetermined level in which the power supplied by AC power mains 102 exists. By reducing the magnitude of the difference, variation in the current drawn from AC power mains 102 is reduced.

In one embodiment of controller 106, reducing or increasing the power supplied to one or both heater 112 and heater 114 involves, respectively, decreasing increasing a duty cycle of one or both of the pulse width modulated signals provided to heater 112 and heater 114. Where the power supplied to heater 112 and/or heater 114 is reduced, the effectiveness of system 100 in its operation, such as in vaporizing fluid, may be affected. However, the heat stored in mass 116 heating the air moving across mass 116 will at least partially offset the reduction in the power supplied to heater 112 and heater 114, reducing the performance impact that would otherwise occur while sufficient heat stored in mass 116 can be removed from mass 116.

In one embodiment of system 100, controller 106 may be operated and the heating capability of heater 112 and heater 114 are sized so that during times when relatively high power is supplied to heater 112 to achieve a relatively high rate of fluid vaporization no power, or reduced power, is supplied to heater 114 so that a sum of a level of power supplied to heater 112 and heater 114 substantially equals a predetermined value. During times when no power, or reduced power is supplied to heater 112 to achieve a relatively low rate of fluid vaporization, the power supplied to heater 114 would be increased for a time to raise the temperature of the mass to a desired temperature so that for that time the sum of the level of power supplied to heater 112 and heater 114 substantially equals the predetermined value. Operation of controller 106 in this manner reduces variation in the current supplied by AC power mains 102.

There may be periods of time for which system 100 is transitioning between operating states. For example, during a period of time system 100 may go from a condition in which substantially no power is supplied to heater 112, with heater 114 being operated at a reduced level of power to maintain the temperature of mass 116, to a condition in which sufficient power is supplied to heater 112 so that it operates at its greatest rated power. During the transition between these conditions, controller 106 may be operated so that the current supplied by AC power mains 102 to system 100 increases substantially linearly at a moderate rate. By controlling a rate of change of the current provided by AC power mains 102 in this manner, voltage transients in the voltage provided by AC power mains 102 are reduced. It should be recognized that other current rate of change profiles could be used to accomplish changing the current provided by AC power mains 102 without causing large voltage transients. For example, a rising exponential rate of change of current, similar in shape to a voltage waveform across a capacitor in an RC circuit, could be followed.

Another example of a transition between operating states would be during a period of time in which system 100 would go from a condition in which heater 112 is operated at its greatest rated power, with heater 114 being operated at a reduced level of power, to a condition in which substantially no power is supplied to heater 112. During the transition between these conditions, controller 106 may be operated so that the current supplied by AC power mains 102 to system 100 decreases substantially linearly at a moderate rate. As was the case with the increasing current profile described in the previous paragraph, voltage transients are reduced. Furthermore, other current rate of change profiles could be used to accomplish changing the current provided by AC power mains 102 without causing large voltage transients. For example, a decaying exponential rate of change of current, similar in shape to a voltage waveform across a capacitor in an RC circuit, could be followed.

Shown in FIG. 2 is a graph for illustrating an embodiment of a technique for applying power referenced in the previous paragraphs. Vertical axis 200 corresponds to power available, in the air moving across heater 112 and mass 116, to vaporize fluid. Horizontal axis 202 represents time. The level on vertical axis 200 corresponding to the intersection 204 with horizontal axis 202 may correspond to a non-zero baseline level of power available in some modes of operation.

In this embodiment, at the time corresponding to point 204, controller 106 begins a linear increase, such as a substantially linear increase, in the power (by increasing the current) supplied to heater 112. At the time corresponding to point 204, air is caused to move by heater 112 and mass 116. The heat energy stored in mass 116 from heater 114 before the time corresponding to point 204 permits a relatively rapid increase in the power available for vaporizing fluid, up to level 206, when air begins to move. As the heat energy stored in mass 116 is extracted by the airflow moving across it, the power provided by mass 116 to the air drops. Contemporaneously, the power provided to the air by heater 112 begins to increase linearly (as indicated by dashed line 208) with time, offsetting the reduction in power provided by mass 116 so that power available for vaporizing fluid is maintained, during the time period corresponding to dashed line 208, within a range of level 206. This range is influenced by factors including the material forming mass 116, the heat transfer characteristics of mass 116, the quantity of material included in mass 116, and the temperature of the air moving by mass 116 and heater 112. In one embodiment, the time period corresponding to dashed line 208 is selected so that at the end of the time period zero (which includes substantially zero) power is transferred from mass 116 to the air moving by mass 116. Thus, system 100 provides the capability to rapidly provide power for vaporizing fluid while maintaining relatively low voltage transients in the voltage provide by AC power mains 102 because of the relatively low rate of change in current drawn from AC power mains 102.

At the time corresponding to point 210, controller 106 begins to apply power to heater 114 in a manner so that the power substantially linear decreases with time while the power supplied to heater 112 is substantially zero. The power supplied to heater 114 during the linear decrease serves to return the heat energy stored in mass 116 to its value at a time prior to point 204 while reducing the magnitude of voltage transients caused on AC power mains 102. The time interval between 210 and 212 may be selected so the desired amount of heat energy can be stored in mass 116 during the linear decrease. It should be recognized that in other embodiments of this technique, the shape of the current profile while the current is increasing may be different than when the current is decreasing, and/or the rate of current change for the current increasing and current decreasing time periods may be different.

Shown in FIG. 3 is a simplified block diagram of an embodiment of an image forming system, inkjet printing system 300. Inkjet printing system 300 is shown in a simplified form for ease of illustration. Inkjet printing system 300 includes an embodiment of a media movement mechanism, media drive 302, to move media, such as a unit of media 304, from a media storage bin (not shown in FIG. 3) past an embodiment of a colorant ejection device, such as printhead 306 during an image forming operation. Printhead 306 represents, as may be used in various embodiments of inkjet printing system 300, an array of one or more printheads. For ease of illustration, media drive 302 is shown as present at one location in the media path. However, in other embodiments, structure associated with media drive 302 may be located at various places within inkjet printing system 300 to perform the function of moving media within inkjet printing system 300.

As media 304 moves past printhead 306, colorant, such as ink 332, is ejected onto media 304 to form an image corresponding to image data received by ink jet printing system 300. Signals provided to printhead 306 cause ejection of the ink from printhead 306 to form the image. Drive electronics 308 generate the signals to cause printhead 306 to eject the ink to form the image. An embodiment of a processing device, such as controller 310, provides data, formed using the image data, to drive electronics 308 to generate the signals provided to printhead 306. In various embodiments, controller 310 may include a microprocessor executing firmware or software instructions to accomplish its tasks. Or, controller 310 may be included in an application specific integrated circuit (ASIC), formed of hardware and controlled by firmware specifically designed for the tasks it is to accomplish. Controller 310 may include a configuration to provide signals to media drive 302 to influence the movement of media through inkjet printing system 300 for accomplishing the image formation operation.

An embodiment of a power source, such as AC power mains 312 provides power to inkjet printing system 300. An embodiment of a current interruption device, such as circuit breaker 334, interrupts the flow of current if it exceeds a threshold at which circuit breaker 334 is designed to actuate. The power supplied to inkjet printing system 300 by AC power mains 312 includes the power supplied to heating element 322, heating element 324, and the other assemblies included in inkjet printing system 300. Power supply 314 includes the capability to provide the voltages used to operate some of the assemblies included within inkjet printing system 300, such as controller 310, drive electronics 308, media drive 302, printhead 306, power control circuit 316, power control circuit 318, and power measurement device 320.

Inkjet printing system 300 includes the capability to operate in a manner to reduce variation in current provided from AC power mains 312 to inkjet printing system 300. As mentioned previously, reducing variation in the current drawn from AC power mains 312 reduces a magnitude of voltage transients in the voltage supplied by AC power mains 312, thereby reducing variation in intensity in output of lights also powered by AC power mains 312. Controller 310 can be configured to include the capability to control the application of power to heating element 322 (using power control circuit 316) and heating element 324 (using power control circuit 318) to reduce variation in the current provided from AC power mains 312 to inkjet printing system 300.

An embodiment of an air movement device, such as blower 326, is configured to move air across mass 328 and heating element 322 to assist in transferring heat stored in mass 328 and heat generated in heating element 322 to the air moving across these structures. Heated air 330 moves across media 304 onto to which ink 332 has been deposited during an image forming operation. Heated air 330 at least partially vaporizes fluid, such as water, included in ink 332.

A signal indicative of the power supplied by AC power mains 312 to inkjet printing system 300 is provided by an embodiment of a power measurement device, power measurement device 320. In one embodiment of power measurement device 320, the signal could be a digital value corresponding to the level of power measured by power measurement device 320. In another embodiment, the signal could have a frequency that varies in proportion to the level of power measured. In one embodiment, power measurement device 320 includes an embodiment of a voltage measurement device to measure a voltage across AC power mains 312 and a current measurement device to measure a current supplied by AC power mains 312. The power supplied by AC power mains 312 could be determined from the measured voltage and the measured current. Determination of the power supplied by AC power mains 312 from a voltage measurement and a current measurement could also be done within controller 310. In a manner similar to described for the operation of system 100, the signal provided by power measurement device 320 is used by controller 310 to control the power supplied to heating element 320 and heating element 322.

Controller 310 determines a difference between the level of power measured by power measurement device 320 and a desired level of power to be supplied to inkjet printing system 300 for the mode in which it is operating corresponding to a predetermined value. For example, during an image forming operation in which it is desired to vaporize fluid from ink 332 deposited on media 304, inkjet printing system 300 will be operating in a relatively high power consumption mode because power will be applied to one or both of heating element 322 and heating element 324 sufficient to vaporize fluid to a desired level. But, during a mode of operation after vaporizing fluid from ink 332 or a mode of operation in which inkjet printing system 300 is waiting for a command to begin performing a print job, inkjet printing system 300 may be operating in a relatively low power consumption mode in which reduced power is supplied to heating element 324 to maintain a temperature of mass 328.

In one embodiment, using the difference, controller 310 operates to control the power supplied to heating element 322 and heating element 324 so that the power supplied by AC power mains 312 to inkjet printing system 300 remains within a range of a predetermined level of power. In one embodiment, this may be accomplished by controller 310 adjusting the level of power supplied to heating element 322 (using power control circuit 316) and to heating element 324 (using power control circuit 318) so that a sum of the power supplied to the elements remains within the range of the predetermined level. For example, when the power supplied to heating element 322 is reduced or stopped after vaporizing fluid included in ink 332, the power supplied to heating element 324 is increased a corresponding amount to replenish the heat energy removed from mass 328 during vaporizing of fluid included in ink 332. When vaporizing fluid included in ink 332 during an image forming operation begins, the power supplied to heating element 324 is reduced or stopped and the power supplied to heating element 322 is increased a corresponding amount. Inkjet printing system 300 is thus able to reduce the variation in current drawn from AC power mains 312 in a manner similar to what was described for system 100.

As was described for the operation of system 100 with respect to FIG. 2, controller 310 can be similarly operated so that in transitioning between modes of operation for inkjet printing system 300, the rate of change of power supplied by AC power mains 312 to inkjet printing system 300 remains relatively low. This can be accomplished by controller 310 causing heating element 322 to linearly (or following another current change profile) increase its power over time when entering an image formation mode of operation that will involve vaporizing fluid included in ink 332 and stopping the application of power to heating element 324. When inkjet printing system 300 is transitioning from a mode of operation in which fluid in ink 332 is vaporized to one in which inkjet printing system 300 is waiting to receive a print job, controller 310 may stop the supply of power to heating element 322 while linearly (or following another current change profile) decreasing the power supplied to heating element 324, similar to what is shown and described for FIG. 2, to replenish the heat energy stored in mass 328. Operating inkjet printing system 300 in this manner during the transitions between modes of operation reduces the magnitude of voltage transients caused on AC power mains 312.

Shown in FIG. 4 is an embodiment of an enclosure, such as enclosure 400 that may be used in an embodiment of inkjet printing system 300. The use of enclosure 400 permits increased efficiency in maintaining the temperature of mass 402 by heating element 404 during the period of time for which it is not desired to extract heat for vaporizing fluid. Enclosure 400 includes embodiments of valves, such as flap 406 and flap 408. Flap 406 is attached to enclosure 400 and constructed of suitably light weight material to permit the force from moving air 410 to move it to an open position during the times in which is desired to extract heat from mass 402. Moving air 410 would then be available to move by heating element 322 as shown in FIG. 3. Also during these times flap 408 is held in an open position by an embodiment of an actuator, such as solenoid 412, to allow moving air 414 to move by mass 402.

FIG. 4 shows flap 408 in the open position and the closed position with dashed lines. Solenoid 412 includes a linkage coupled to flap 408 and configured to permit flap 408 to move between the open position and closed position by the action of solenoid 412. Controller 310 may be configured to provide a control signal to actuate solenoid 412 for moving flap 408 between the open and closed positions. During times in which it is not desired to extract heat from mass 402, solenoid 412 holds flap 408 in the closed position so that moving air 414 is diverted around enclosure 400 and could move by heating element 322 as shown in FIG. 3. During this time air is substantially stopped from moving through enclosure 400. Enclosure 400 may be insulated to further increase the efficiency of maintaining the temperature of mass 402.

While the disclosed embodiments have been particularly shown and described, those skilled in the art will understand that many variations may be made to these without departing from the spirit and scope defined in the following claims. The detailed description should be understood to include all novel and non-obvious combinations of the elements that have been described, and claims may be presented in this or a later application to any novel and non-obvious combination of these elements. Combinations of the above exemplary embodiments, and other embodiments not specifically described herein will be apparent to those of skill in the art upon reviewing the above detailed description. The foregoing embodiments are illustrative, and any single feature or element may not be included in the possible combinations that may be claimed in this or a later application. Therefore, the scope of the claimed subject matter should be determined with reference to the following claims, along with the full range of equivalents to which such claims are entitled.

What is claimed is:

1. An apparatus, comprising:

a mass to store heat;

a first heater to heat the mass;

a device to measure power provided by a power source;

a second heater; and a controller to maintain a sum of a level of power supplied to the first heater and a level of power supplied to the second heater within a range of a predetermined value using a measurement of a level of the power provided by the power source, wherein the mass, the first heater, the device, the second heater, and the controller are included in an image forming system, wherein the controller is configured to linearly increase power to the second heater and stop power to the first heater when the system is transitioning to an image forming mode, and stop power to the second heater and linearly decrease power to the first heater when the system is transitioning from the image forming mode.

2. The apparatus as recited in claim 1, further comprising:

a plurality of assemblies to be supplied power by the power source, with a sum of the level of power supplied to the first heater, the level of power supplied to the second heater, and a level of power supplied to the plurality of assemblies to equal the level of the power provided by the power source.

3. The apparatus as recited in claim 2, wherein:

the first heater includes a first heating element and a first power controller to regulate the level of power supplied to the first heater; and the second heater includes a second heating element and a second power controller to regulate the level of power supplied to the second heater.

4. The apparatus as recited in claim 3, wherein:

the controller includes a configuration to adjust the level of power supplied to the first heater using the first power controller and the level of power supplied to the second heater using the second power controller according to a difference between the measurement of the level of the power provided by the power source and the predetermined value.

5. The apparatus as recited in claim 1, further comprising:

a dryer including the second heater;

6. The apparatus as recited in claim 5, wherein:

the image forming system includes the dryer.

7. The apparatus as recited in claim 1, wherein:

the controller includes a configuration to increase the power supplied to the second heater during a first time period from a first value to a second value so that a sum of the level of power supplied to the second heater and heat to be transferred to air moving by the mass exists within a second range of a second predetermined value during the first time period.

8. The apparatus as recited in claim 7, wherein:

the controller includes a configuration to increase the power supplied to the second heater linearly during the first time period.

9. The apparatus as recited in claim 7, wherein:

the controller includes a configuration to decrease the power supplied to the second heater to zero during a second time period and decrease the power supplied to the first heater during the second time period from the second value at a beginning of the second time period to the first value at an end of the second time period so that a sum of the level of power supplied to the second heater and the level of power supplied to the first heater exists within the second range of the second predetermined value during the second time period.

10. The apparatus as recited in claim 1, further comprising:

an enclosure to enclose the mass and having a first valve and a second valve configured to control a flow of air through the enclosure.

11. An apparatus, comprising:

a mass to store heat;

a first heater to heat the mass;

a device to measure first-power provided by a power source;

a second heater; and means to maintain a sum of a level of power to be supplied to the first heater and a level of power to be supplied to the second heater within a range of a predetermined value using a measurement of a level of the power provided by the power source, wherein the mass, the first heater, the device, the second heater, and the means to maintain are included in an image forming system, wherein the means to maintain linearly increases power to the second heater and stops power to the first heater when the system transitions to an image forming mode, and stops power to the second heater and linearly decreases power to the first heater when the system transitions from the image forming mode.

* * * * *

UNITED STATES PATENT AND TRADEMARK OFFICE

CERTIFICATE OF CORRECTION

PATENT NO. : 7,461,925 B2
APPLICATION NO. : 11/073139
DATED : December 9, 2008
INVENTOR(S) : David E. Smith et al.

It is certified that error appears in the above-identified patent and that said Letters Patent is hereby corrected as shown below:

In column 10, line 44, in Claim 5, delete "heater;" and insert -- heater. --, therefor.

In column 11, line 10, in Claim 11, after "measure" delete "first-".

Signed and Sealed this

Sixth Day of October, 2009

David J. Kappos

David J. Kappos
*Director of the United States Patent and Trademark Office*